US011752546B2

(12) United States Patent
Pietribiasi

(10) Patent No.: US 11,752,546 B2
(45) Date of Patent: Sep. 12, 2023

(54) APPARATUS AND METHOD FOR THE DIE CASTING IN THE SEMISOLID STATE OF OBJECTS MADE OF BRASS, BRONZE, ALLOYS OF ALUMINUM, MAGNESIUM AND LIGHT ALLOYS AND THE LIKE

(71) Applicant: EUROMAC SRL, Marano Vicentino (IT)

(72) Inventor: Michele Pietribiasi, Marano Vicentino (IT)

(73) Assignee: EUROMAC SRL, Marano Vicentino (IT)

( * ) Notice: Subject to any disclaimer, the term of this patent is extended or adjusted under 35 U.S.C. 154(b) by 0 days.

(21) Appl. No.: 17/767,094

(22) PCT Filed: Oct. 6, 2020

(86) PCT No.: PCT/IB2020/059362

§ 371 (c)(1),
(2) Date: Apr. 7, 2022

(87) PCT Pub. No.: WO2021/070044

PCT Pub. Date: Apr. 15, 2021

(65) Prior Publication Data

US 2022/0362841 A1 Nov. 17, 2022

(30) Foreign Application Priority Data

Oct. 7, 2019 (IT) ..... 102019000018053

(51) Int. Cl.
*B22D 18/02* (2006.01)
*B22C 9/06* (2006.01)
*B22D 18/06* (2006.01)

(52) U.S. Cl.
CPC ..... *B22D 18/02* (2013.01); *B22C 9/067* (2013.01); *B22D 18/06* (2013.01)

(58) Field of Classification Search
CPC ..... B22D 18/02; B22D 18/06; B22C 9/067
See application file for complete search history.

(56) References Cited

U.S. PATENT DOCUMENTS

2007/0215308 A1 9/2007 Masubara et al.

FOREIGN PATENT DOCUMENTS

EP 2977127 A1 1/2016

OTHER PUBLICATIONS

International Search Report dated Jan. 2, 2021 re: Application No. PCT/IB2020/059362, pp. 1-3, citing: US 2007/215308 A1 and EP 2 977 127 A1.

(Continued)

*Primary Examiner* — Kevin P Kerns
*Assistant Examiner* — Steven S Ha
(74) *Attorney, Agent, or Firm* — CANTOR COLBURN LLP

(57) ABSTRACT

An apparatus for the die casting in the semisolid state of objects made of brass, bronze, alloys of aluminum, magnesium and light alloys and the like, includes an upper die part adapted to be mated with a lower die part, the mating between the upper die part and the lower die part forming a casting cavity, a furnace being arranged below the lower die part and being provided with a duct for feeding liquid metal which connects to the casting cavity. The upper die part is provided with a cavity in which a forging piston can move freely, the piston accommodating internally a flow control plunger, and having, between the upper die part and the lower die part, circumferentially around the part to be cast, a vacuum channel connected to the casting cavity by at least one venting channel.

7 Claims, 4 Drawing Sheets

(56) References Cited

OTHER PUBLICATIONS

IT Search Report dated May 27, 2020 re: Application No. 201900018053, pp. 1-7, citing: US 2007/215308 A1 and EP 2 977 127 A1.
Written Opinion dated Jan. 2, 2021 re: Application No. PCT/IB2020/059362, pp. 1-5, citing: US 2007/215308 A1 and EP 2 977 127 A1.

APPARATUS AND METHOD FOR THE DIE CASTING IN THE SEMISOLID STATE OF OBJECTS MADE OF BRASS, BRONZE, ALLOYS OF ALUMINUM, MAGNESIUM AND LIGHT ALLOYS AND THE LIKE

TECHNICAL FIELD

The present disclosure relates to an apparatus and a method for the die casting in the semisolid state of objects made of brass, bronze, alloys of aluminum, magnesium and light alloys and the like.

More particularly, the disclosure relates to an apparatus and a method for providing objects at low pressure and forged in the semisolid state.

BACKGROUND

As is known, in the production of objects of small and medium size there are problems of quality of the product, which must not have gas or air impurities, and must have the shortest possible cycle time besides having high mechanical characteristics.

An apparatus is known in the art which is provided with a lower die and an upper die which define an area for the containment of a dosed quantity of liquid metal that originates from a duct which is arranged in communication with a furnace and originates from below.

In such a technical solution, the upper die is provided with a flow control element which acts on a communication port of the liquid metal intake duct and a pressing plunger which defines a portion of the upper impression of the die.

The die is thus filled by overflow of the liquid metal, with the drawback, however, of not knowing exactly the quantity of metal required to complete the workpiece.

Moreover, the dosage of the metal may be incorrect, since in the initial step the die is not filled completely, but the liquid metal reaches the level of the overflow line, thus obtaining the complete filling of the die only after the closure of the port for communication with the liquid metal intake duct and the lowering of the pressing plunger, which makes the liquid metal rise to completing the cavity of the die.

The solution proposed above is susceptible of improvements.

The use of low pressure for the casting process entails that the furnace is arranged under the casting machine and must be pressurized. Furnace pressurization, usually provided by means of air, cools the metal and therefore the use of a hermetic furnace is required.

During the step for filling the cavity of the die and pressurizing the furnace, the air that is present in the riser tube and in the cavity of the die must exit from the die in order to allow the introduction of liquid metal.

In known apparatuses for the rise of the liquid metal from the furnace to the cavity of the die, a pressure is used to be applied on said surface of the metal that is in the furnace. The pressurization of the furnace chamber entails the use of a furnace of a special type, and furthermore it is not possible to top up the furnace while the apparatus is working.

Moreover, it is not possible to control the state of the metal since the furnace is of the hermetically closed type.

Moreover, when the furnace chamber is pressurized there is air in the metal riser duct and before the metal rises in the duct such air must be expelled from the venting elements that are present on the die closure, like the air that is in the casting cavity.

SUMMARY

The aim of the present disclosure is to provide an apparatus and a method for the die casting in the solid state of objects made of brass, bronze, alloys of aluminum, magnesium and light alloys and the like, which makes it possible to obtain die cast parts in the semisolid state without pressurizing the supply furnace and without air in the metal riser tube and in the casting cavity, with a reduction therefore of the production costs of the apparatus.

Within this aim, the present disclosure provides an apparatus and a method for the die casting in the semisolid state of objects made of brass, bronze, alloys of aluminum, magnesium and light alloys and the like, in which it is possible to use a non-pressurized furnace.

The present disclosure provides an apparatus and a method in which the parts obtained are without porosity.

The present disclosure provides an apparatus and a method in which machine downtime for topping up liquid metal in the furnace is not required.

The present disclosure provides an apparatus and a method in which it is possible to control the state of the metal contained in the furnace while the apparatus is operative.

The present disclosure provides an apparatus and a method that are highly reliable, relatively simple to provide and at competitive costs.

This aim and these and other advantages which will become better apparent hereinafter are achieved by providing an apparatus for the die casting in the semisolid state of objects made of brass, bronze, alloys of aluminum, magnesium and light alloys and the like, comprising a die constituted by an upper die part adapted to be mated with a lower die part, the mating between said upper die part and said lower die part forming a casting cavity, a furnace being arranged below said lower die part and being provided with a duct for feeding liquid metal which connects to said casting cavity, said upper die part being provided with a cavity in which a forging piston can move freely, said piston accommodating internally a flow control plunger, characterized in that it comprises, between said upper die part and said lower die part, circumferentially around the part to be cast, a vacuum channel connected to said casting cavity by means of at least one venting channel.

BRIEF DESCRIPTION OF THE DRAWINGS

Further characteristics and advantages of the disclosure will become better apparent from the description of a preferred but not exclusive embodiment, of the apparatus and the method according to the disclosure, illustrated by way of non-limiting example in the accompanying drawings, wherein.

DETAILED DESCRIPTION OF THE DRAWINGS

Figure 1:
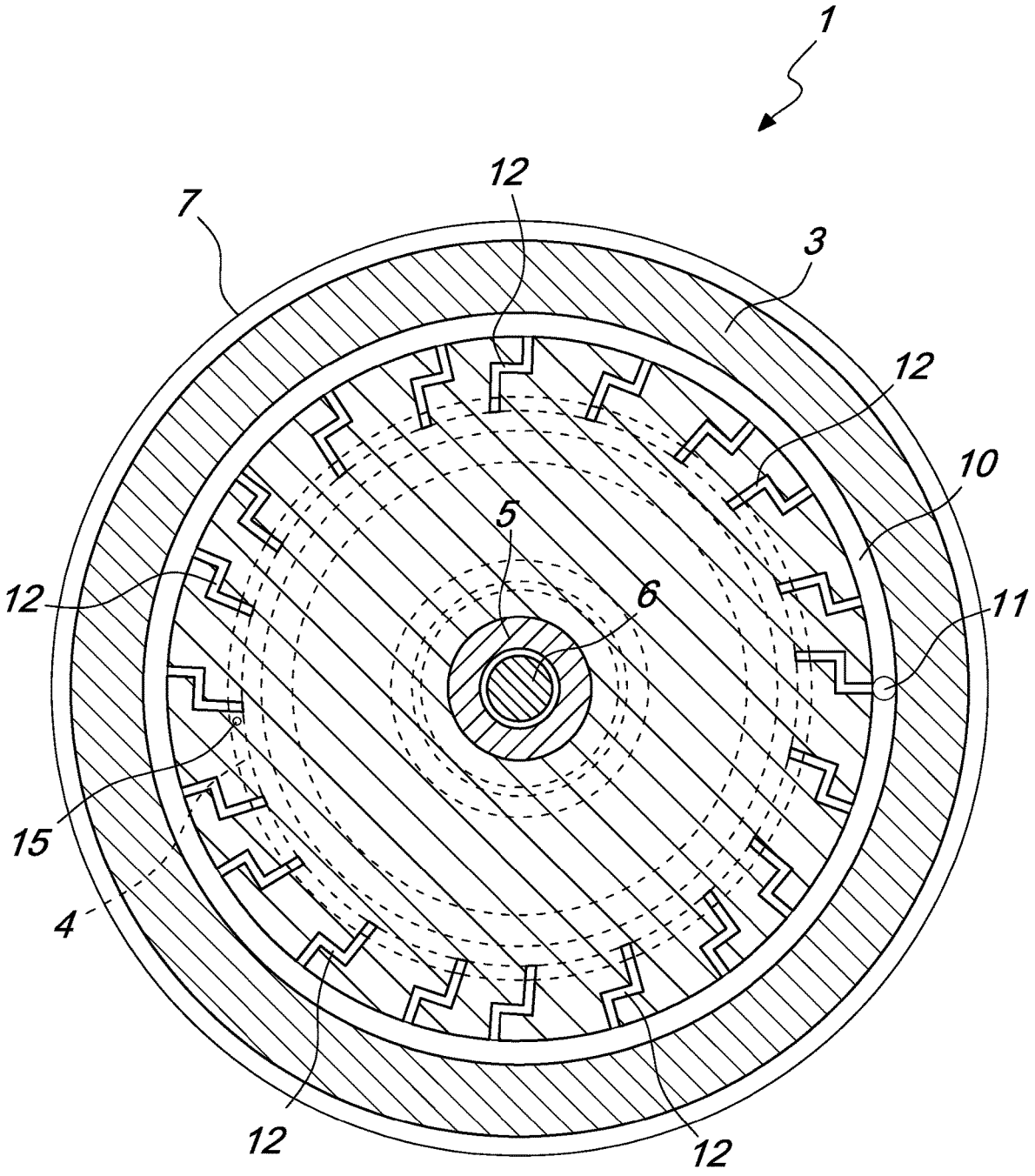
FIG. 1 is a plan view of the apparatus according to the present disclosure.

With reference to the figures, the apparatus according to the disclosure will be described at first and subsequently the method for using it.

In all the figures, identical elements are designated by identical reference numerals.

The apparatus according to the disclosure, generally designated by the reference numeral 1, comprises a die constituted by a lower die part or matrix 2 which can be mated to an upper die part or matrix 3 in order to form a casting cavity 4; a forging piston 5 can move in a channel defined within the upper die part 3 and accommodates internally a flow control plunger 6.

Below the lower die part 2 there is a furnace 7 adapted to contain liquid metal 8. The furnace 7 is provided with a channel 9 for the rise of the liquid metal toward the casting cavity 4.

Conveniently, there is a channel 10 for feeding vacuum by means of a vacuum pump which can be connected at the point 11; said channel 10 is connected by means of at least one venting channel 12, and preferably a plurality of venting channels 12, to the casting cavity 4.

The venting channels 12 are provided in order to contact the surface of the part being processed, being arranged perimetrically around said surface.

Preferably, the venting channels 12 are provided with a zigzag shape or in any case are not rectilinear.

In turn, the forging piston 5 which accommodates the flow control plunger 6 is provided with a channel 14 for creating vacuum arranged at its upper region, and venting channels 13 arranged at a substantially intermediate region thereof, which can be closed by the flow control plunger in its stroke inside the forging piston 5.

Figure 3:
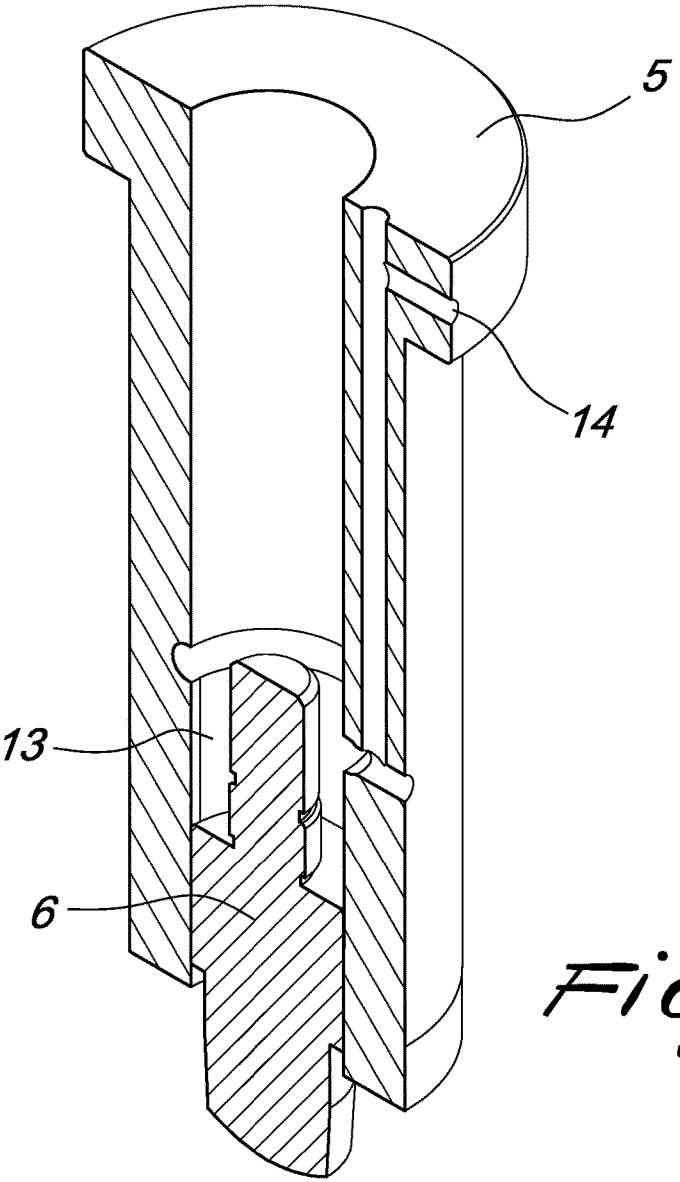
FIG. 3 is a perspective view of the forging piston of FIG. 2 with the corresponding flow control element in a second active condition.
Figure 2:
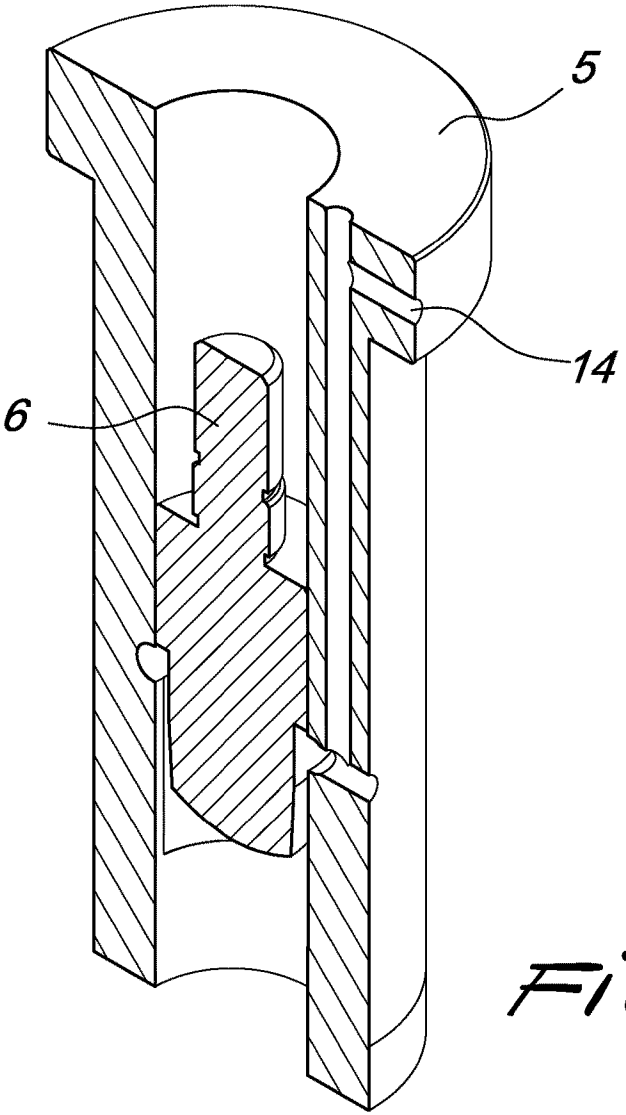
FIG. 2 is a perspective view of the forging piston of the apparatus according to the disclosure with the corresponding flow control element in a first active condition.

FIG. 2 shows the condition in which the flow control plunger 6 keeps the venting channels 13 open and FIG. 3 shows the position of the flow control plunger 6 that allows to keep the venting channels 13 closed.

Conveniently, the upper die part 3 is provided with a sensor 15 for the level of the metal in the casting cavity 4.

The method of use of the apparatus according to the disclosure is as follows.

Figure 4:
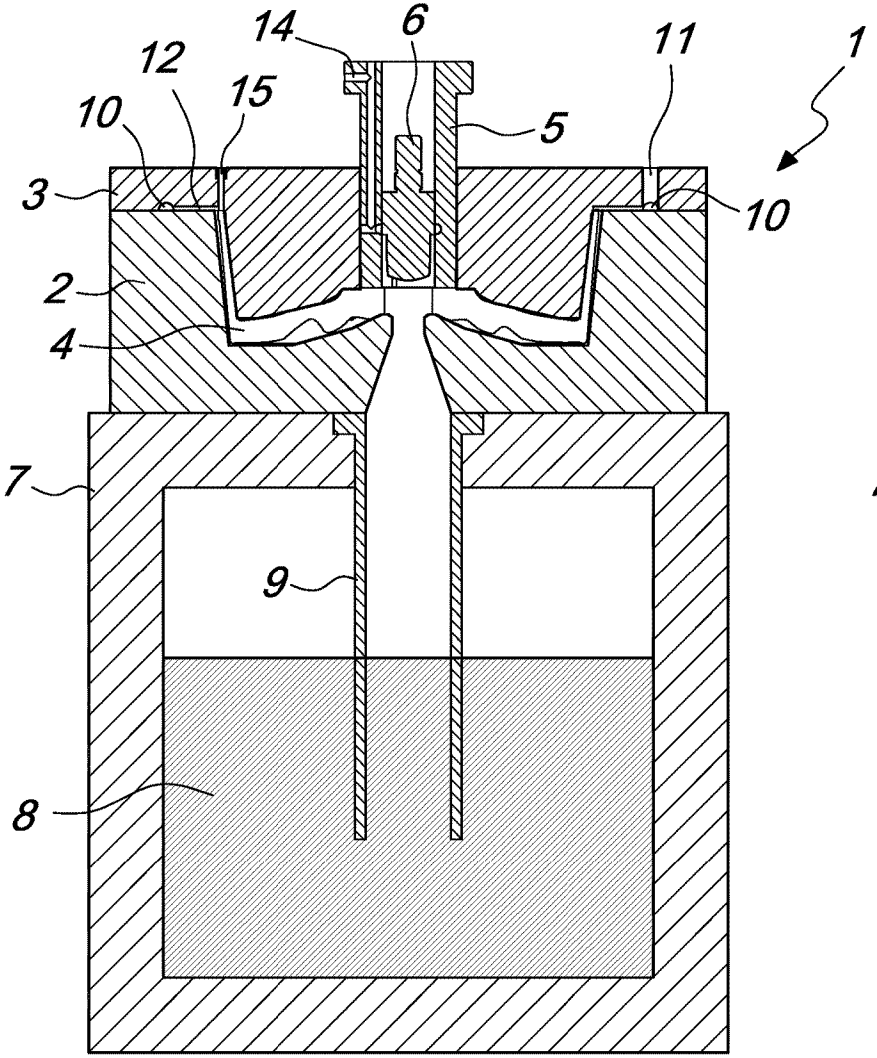
FIG. 4 is a transverse sectional view of the apparatus according to the present disclosure in a first active condition.

With reference to FIG. 4, an apparatus according to the disclosure is shown in the closed die condition with the furnace 7 containing the liquid metal 8 applied thereto and active vacuum both on the vacuum channel 10 (by means of the vacuum pump attached at the point 11) and on the venting elements 13 on the forging piston 5, so that the rise of metal 8 in the casting cavity 4 and in the forging piston 6 by means of a negative pressure is allowed.

The step shown in FIG. 4 provides for the creation of vacuum simultaneously at the vacuum connection channel 14 formed on the flow control plunger 5 and simultaneously also at the channel 11.

Figure 5:
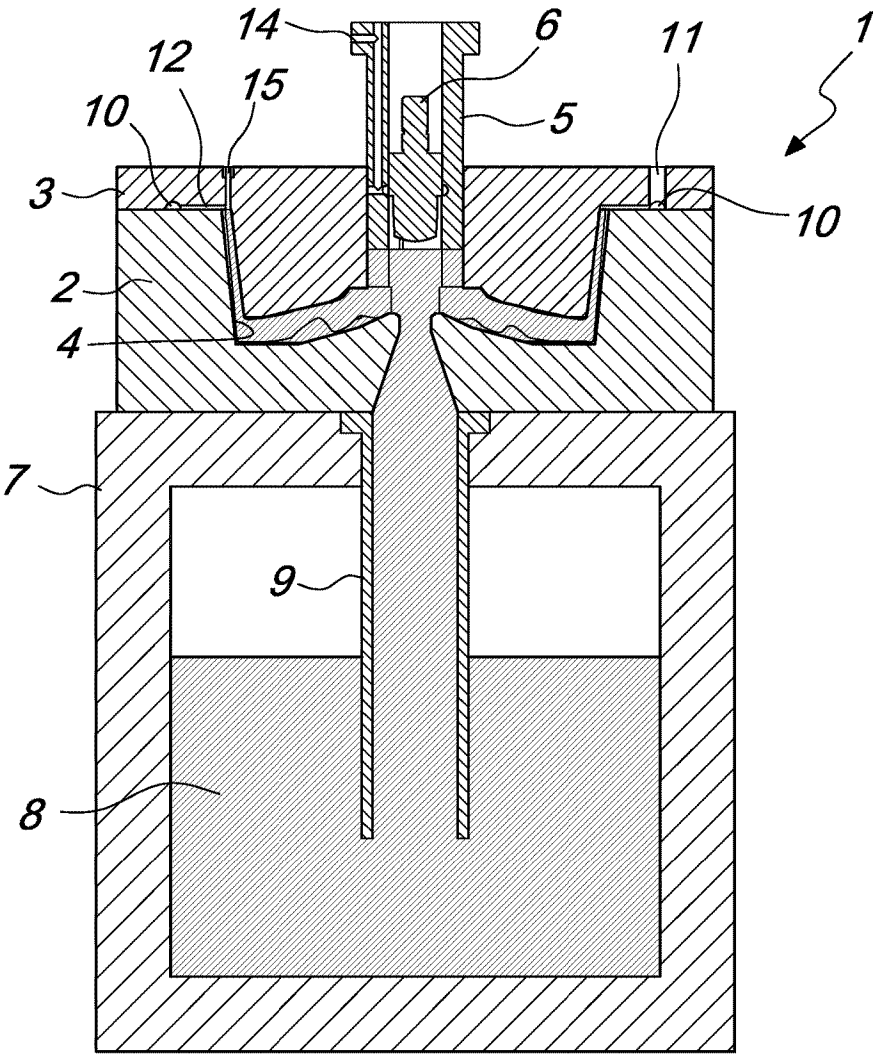
FIG. 5 is a transverse sectional view of the apparatus according to the disclosure in a second active condition.

FIG. 5 is a view of the step in which the liquid metal enters the channel 9 and fills the casting cavity 4.

In this condition the venting elements 13 of the forging piston are still open due to the position of the flow control plunger 6.

The filling of the casting cavity 4 with liquid metal 8 occurs by negative pressure of the vacuum and by means of the rise of the forging piston 5 with a "syringe effect".

The filling step is regulated by the sensor 15, which determines when to stop the inflow of metal in the casting cavity 4.

FIG. 5 thus shows the apparatus according to the disclosure after the syringe effect has occurred.

Figure 6:
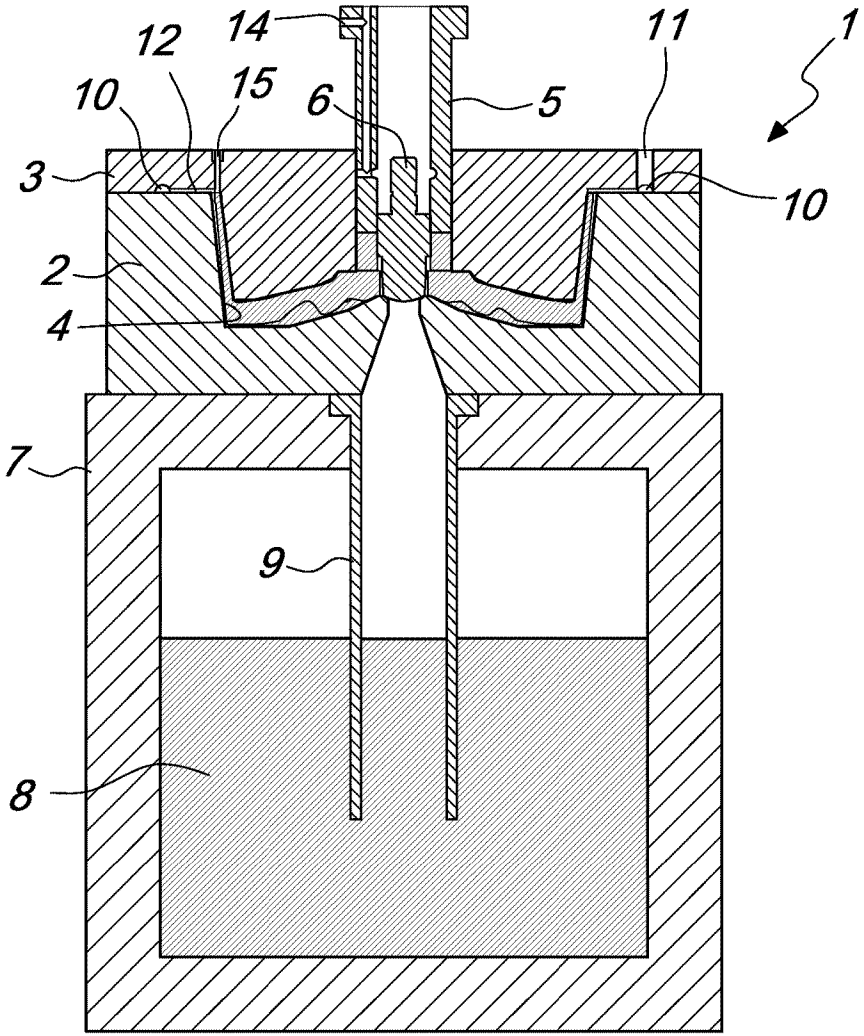
FIG. 6 is a transverse sectional view of the apparatus according to the disclosure in a third active condition.

FIG. 6 shows the lowering of the flow control plunger 6 with consequent closure of the liquid metal feed duct 9 and with the venting elements 13 closed.

In this condition the metal 8 present in the feed duct descends to the level of the metal present in the furnace 7.

Figure 7:
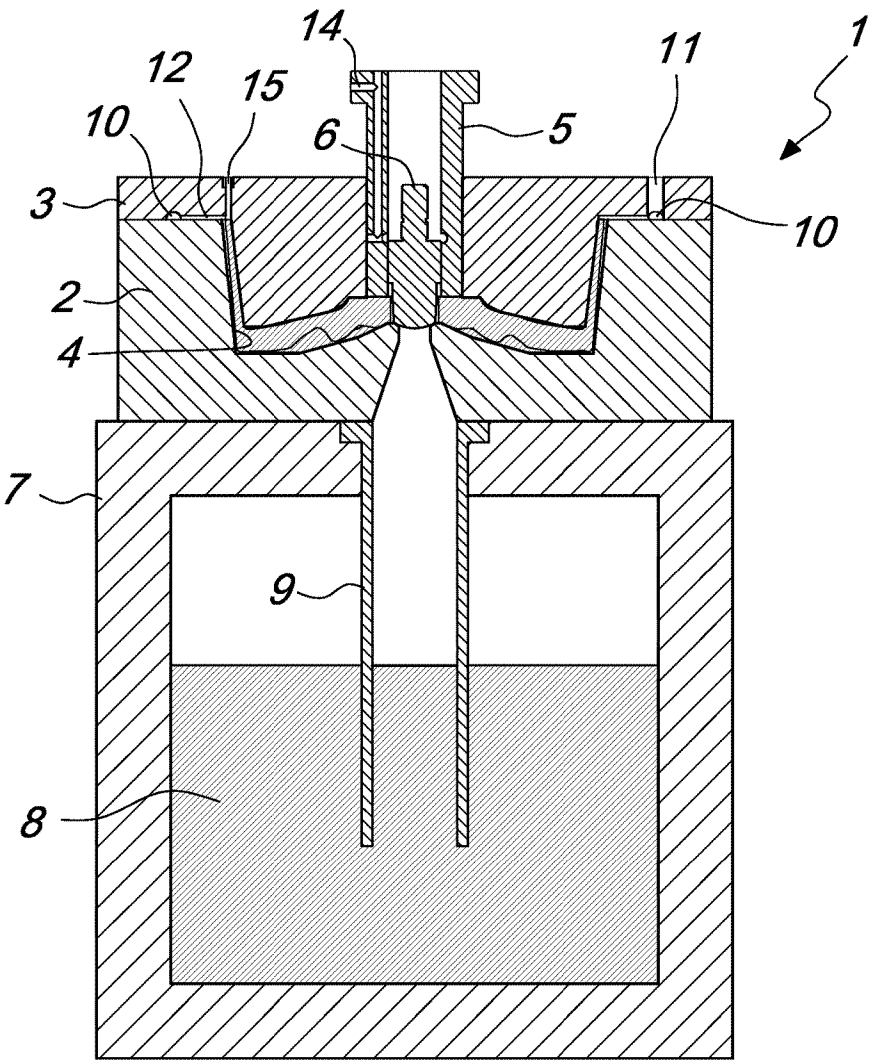
FIG. 7 is a transverse sectional view of the apparatus according to the disclosure in a fourth active condition.

FIG. 7 shows the apparatus according to the disclosure in the forging step, with the duct 9 for feeding the metal 8 closed and with the air venting elements closed, and with the forging piston 5 lowered downward in the end forging position.

This is then followed by a step for opening the die and extracting the part.

In practice it has been found that the apparatus and the method according to the disclosure fully achieve the intended aim and objects, since they allow to use any type of furnace, not necessarily a hermetic one, or in general any type of energy to heat the metal. In this manner, the cost of the furnace is greatly reduced with respect to the furnaces used in the background art.

By creating a negative pressure in the die for the rise of the liquid metal in the first step the air contained in the casting cavity and in the riser channel is extracted and therefore there is an absence of porosity in the final product.

Moreover, with the disclosure it is possible to reduce considerably the cost of the vacuum applied, since the air venting elements through which the metal is drawn close upon the arrival of the metal drawn by the creation of vacuum with a negative pressure that can vary between 0.3 and 1.0 bar.

It is important for the disclosure to apply negative pressure (vacuum) both on the upper die part and on the feed duct of the metal, in order to ensure the presence of the liquid metal in the forging piston.

The apparatus according to the disclosure avoids having to provide for a machine downtime to top up liquid metal, since the furnace is not pressurized.

Furthermore, it is possible to check the state of the metal contained in the furnace while the apparatus is in production, since the furnace, as mentioned, is not pressurized.

The creation of a vacuum channel that runs along all of the external surface of the part to be provided and the connection of said channel to the part to be provided by means of at least one and preferably a series of venting elements on the entire surface of the part allows to draw the metal continuously until all the venting elements are closed by the liquid metal.

The venting elements that connect the vacuum channel to the casting cavity have such dimensions as to make the vacuum and the air pass but not the aspirated metal.

During the forging step at high pressure, for example, up to 1200 kg/cm$^2$, the air venting elements are closed and therefore prevent the outflow of the metal when the high pressure is applied.

Conveniently, the dimensions of the venting elements, which preferably have a zigzag or in any case nonrectilinear profile, has a value in width that can vary from 3 to 15 mm and a depth that can vary from 0.1 mm to 0.8 mm.

The dimensions indicated above are only preferential.

The method and the apparatus thus conceived are susceptible of numerous modifications and variations, all of which are within the scope of the accompanying claims.

All the details may furthermore be replaced with other technically equivalent elements.

In practice, the materials used, as well as the contingent shapes and dimensions, may be any according to the requirements and the state of the art.

The disclosures in Italian Patent Application no. 102019000018053, from which this application claims priority, are incorporated herein by reference.

The invention claimed is:

1. An apparatus for die casting in a semisolid state of objects made of brass, bronze, alloys of aluminum, magnesium and light alloys, the apparatus comprising: a die constituted by an upper die part adapted to be mated with a lower die part, a mating between said upper die part and said lower die part forming a casting cavity, a furnace being arranged below said lower die part and being provided with a feed duct for feeding liquid metal which connects to said casting cavity, said upper die part being provided with a cavity in which a forging piston can move freely, said piston accommodating internally a flow control plunger, and further comprising, between said upper die part and said lower die part, circumferentially around a part to be cast, a vacuum channel connected to said casting cavity by means of at least one venting channel.

2. The apparatus according to claim 1, wherein said upper die part comprises a channel for connection to a vacuum pump, which connects said vacuum channel to the outside.

3. The apparatus according to claim 1, wherein said upper die part comprises a sensor for a level of the liquid metal in the casting cavity.

4. The apparatus according to claim 1, wherein said forging piston comprises a channel for connection to a vacuum, in order to produce vacuum, said vacuum connection channel being arranged at an upper region of said forging piston.

5. The apparatus according to claim 1, wherein said forging piston comprises air venting channels configured to be occluded by said flow control plunger in its stroke within said forging piston.

6. The apparatus according to claim 1, wherein said at least one venting channel of said vacuum channel has a zigzag shape.

7. A method for die casting in a semisolid state of objects made of brass, bronze, alloys of aluminum, magnesium and light alloys, by an apparatus according to claim 1, the method including the following steps:

closing said upper die part onto said lower die part and forming said casting cavity;

by means of said furnace, heating liquid metal contained therein;

creating vacuum in a vacuum channel of the forging piston and making the liquid metal rise in the feed duct to fill the casting cavity;

said vacuum creation step being provided by creating vacuum simultaneously at said vacuum channel of said forging piston and at said vacuum channel of said upper die part, with rise, by syringe effect, of said forging piston;

closing said feed duct by said flow control plunger;

making said forging piston descend in order to perform a forging step; and opening the die and extracting the part.

* * * * *